US010843780B2

(12) United States Patent
Willard

(10) Patent No.: US 10,843,780 B2
(45) Date of Patent: Nov. 24, 2020

(54) OUTBOARD MOTOR COVER

(71) Applicant: Willard Patent LLC, Dartmouth, MA (US)

(72) Inventor: Winn Willard, Dartmouth, MA (US)

(73) Assignee: Willard Patent LLC, Darmouth, MA (US)

( * ) Notice: Subject to any disclaimer, the term of this patent is extended or adjusted under 35 U.S.C. 154(b) by 0 days.

(21) Appl. No.: 16/296,849

(22) Filed: Mar. 8, 2019

(65) Prior Publication Data

US 2019/0283853 A1 Sep. 19, 2019

Related U.S. Application Data

(60) Provisional application No. 62/642,885, filed on Mar. 14, 2018.

(51) Int. Cl.
*B63H 20/32* (2006.01)
*B63B 17/02* (2006.01)

(52) U.S. Cl.
CPC ..... *B63H 20/32* (2013.01); *B63B 17/02* (2013.01)

(58) Field of Classification Search
CPC ..... B63H 20/00; B63H 20/32; B63H 20/34; B63H 21/00; B63H 21/36; B63B 17/02; B63B 17/00
USPC ..... 440/76, 77
See application file for complete search history.

(56) References Cited

U.S. PATENT DOCUMENTS 6,875,066 B2 * 4/2005 Wolaver ..... F01N 1/24 440/77
7,485,019 B1 * 2/2009 Macier ..... B63H 20/32 440/77
9,341,008 B1 * 5/2016 Amerling ..... B63H 20/32

* cited by examiner

*Primary Examiner* — Lars A Olson
(74) *Attorney, Agent, or Firm* — West Hill Technology Counsel

(57) ABSTRACT

A device and technique for reducing noise experienced by boat passengers from an outboard boat motor is discussed. The device may be implemented in the form of a cover that is adjacent to at least a portion of the boat motor. The cover includes one or more walls or surfaces that reflect or attenuate soundwaves. The cover may be attached to the boat motor and/or the boat. The cover may be integral with the boat motor and/or the boat. The cover may be attached to the boat via a hinge to permit the cover to be pivoted away from the boat motor. The materials used to construct the cover may be provided in layers that help to attenuate, absorb or reflect soundwaves.

20 Claims, 6 Drawing Sheets

OUTBOARD MOTOR COVER

CROSS-REFERENCE TO RELATED APPLICATIONS

This application claims the benefit of U.S. Provisional Patent Application Ser. No. 62/642,885, filed Mar. 14, 2018, the entire contents of which are hereby incorporated herein by reference.

STATEMENT REGARDING FEDERALLY SPONSORED RESEARCH OR DEVELOPMENT (Not Applicable)

BACKGROUND

The present disclosure is in the technical field of noise suppression. More particularly, the present disclosure is in the technical field of outboard boat motor noise reduction.

Current boat motors tend to generate noise at levels above accepted standards for health and safety. Some boat motor manufacturers have sought to provide a reduction in noise levels through motor design and/or noise insulation, however, challenges for noise levels remain.

SUMMARY

A device and technique for reducing noise experienced by boat passengers from an outboard boat motor is discussed. The device may be implemented in the form of a cover that is adjacent to at least a portion of the boat motor. In some examples, the cover includes one or more walls or surfaces that reflect or attenuate soundwaves. In at least one example, the cover includes a contoured (curved) surface that is continuous or non-continuous around the top of the motor. The cover may be attached to the boat motor and/or the boat. The cover may be integral with the boat motor and/or the boat. The cover may be attached to the boat via a hinge to permit the cover to be pivoted away from the boat motor. The materials used to construct the cover may be provided in layers that help to attenuate, absorb or reflect soundwaves.

The present disclosure is for an outboard boat motor cover. The cover may provide acoustic absorption or deadening features to reduce noise generated by the boat motor. In some examples, the cover reduces noise emissions from the boat motor that reach the passenger area of the boat.

The cover may be integrated with or separate from the outboard motor. The cover has noise suppression and/or deflection construction and engineering designed for outboard boat motors. The cover absorbs sound and/or deflects it away from operators and passengers. The cover can be attached to the boat or attached to the outboard motor or both. The cover can provide noise suppression and/or deflection for plurality of motors depending on the boat design. The cover can be rigid or flexible, in part or in whole. In some examples, the cover is configured with standoffs that mount to or contact the boat motor. The standoffs can be rubber or other materials, and may be configured in the form of posts. In some examples, the standoffs contribute to reducing vibration that may otherwise increase the noise emission generated by the boat motor.

At least a portion or all of the cover may be constructed from rigid and malleable material, such as sheet metal. The cover may be constructed with a frame over which acoustically responsive material is located. For example, acoustic fabric may be stretched over a frame, including a frame such as that made of sheet metal discussed above.

BRIEF DESCRIPTION OF THE SEVERAL VIEWS OF THE DRAWINGS

The disclosure is described in greater detail below, with reference to the accompanying drawings, in which.

DETAILED DESCRIPTION

Figure 1:
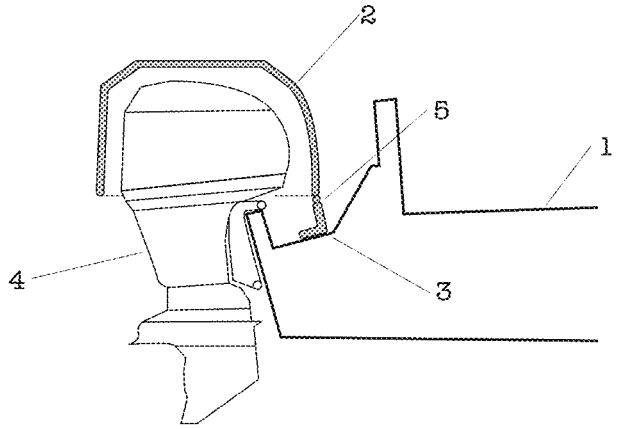
FIG. 1 is a side view of an example outboard boat motor cover installed over a motor on a boat.
Figure 2:
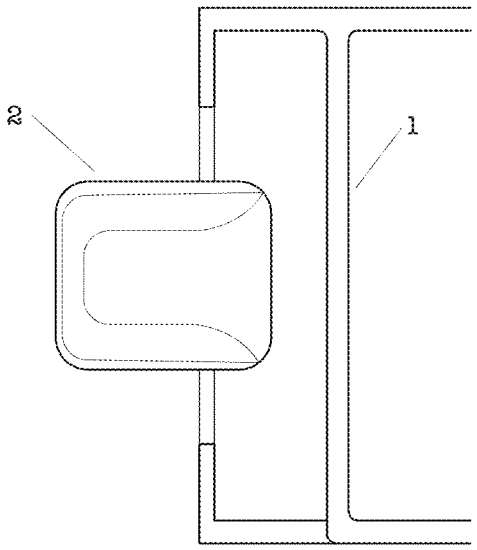
FIG. 2 is a top view of the outboard boat motor cover of FIG. 1.

Broadly stated, the present disclosure relates to a motor cover. Referring to FIGS. 1 and 2, there is shown a boat 1 and a motor 4 having a cover 2 held in position by an attachment 3. Attachment 3 can include any type of fastener, including bolts, screws, adhesives, hook and loop, zippers, snaps and any other type of fastener that can contribute to securing cover 2 to boat 1, including releasable fasteners. Cover 2 includes a hinge 5 to permit cover 2 to be pivoted. Pivoting cover 2 about hinge 5 can provide for easier access to motor 4. Motor 4 may pivot and permitting cover 2 to pivot can avoid interference between cover 2 and motor 4 in a pivoted position. Cover 2 encloses the power head part of motor 4. Cover 2 can enclose motor 4 on two, three, four or five sides, e.g., a front, back, side(s) and/or top.

Cover 2 can be made from rigid material or flexible material. With flexible material, cover 2 can be made to collapse and/or fold. With rigid material, cover 2 can be provided with hinges or folding seams to permit cover 2 to be reduced in size for transport or stowing, etc. Cover 2 can have varying structure depending on the material used for its construction.

Figure 3:
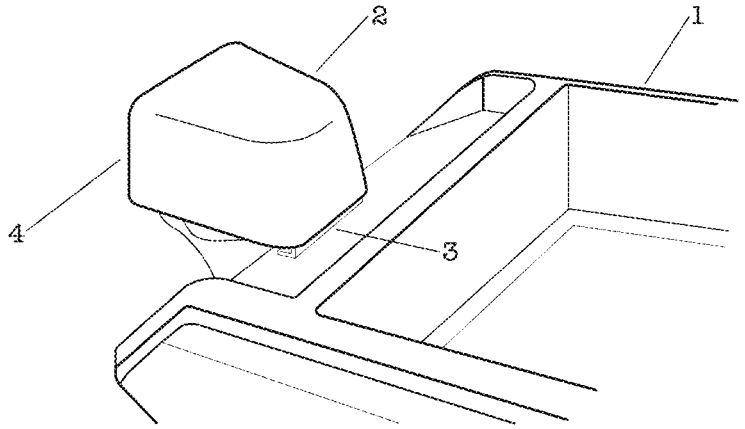
FIG. 3 is a perspective view of the outboard boat motor cover of FIG. 1.
Figure 4:
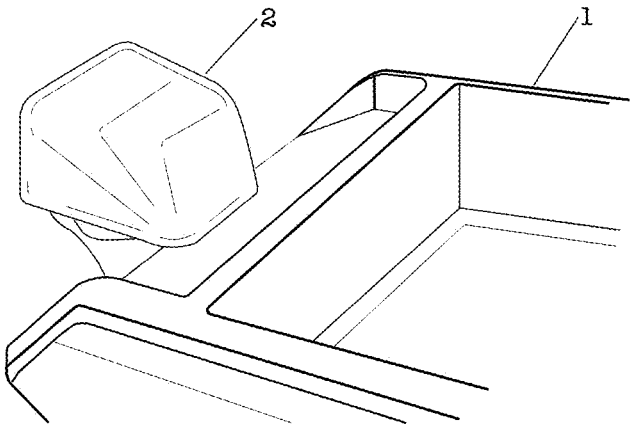
FIG. 4 is a perspective view of another example of an outboard boat motor cover.
Figure 5:
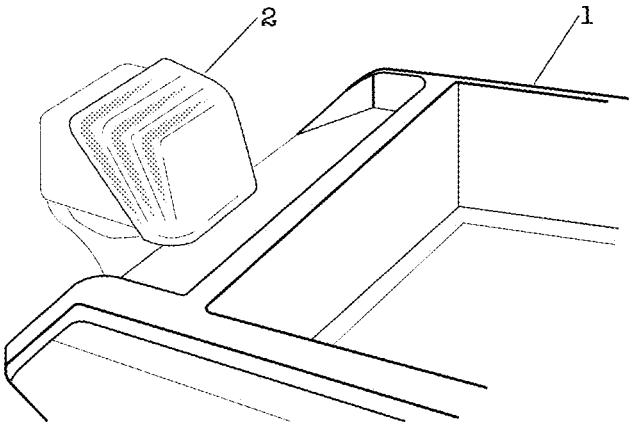
FIG. 5 is a perspective view of another example of an outboard boat motor cover.
Figure 6:
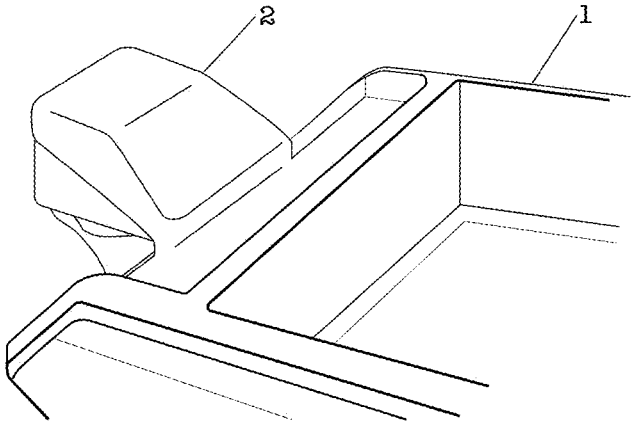
FIG. 6 is a perspective view of another example of an outboard boat motor cover.

Referring to FIG. 3, cover 2 can be in a fixed form. Referring to FIGS. 4 and 5 cover 2 can be collapsible, folding or assembled from multiple pieces for transport. Referring to FIG. 6, cover 2 can be integrated into the structure of boat 1. Additionally, or alternatively, cover 2 can be integrated into the structure of motor 4.

Figure 7:
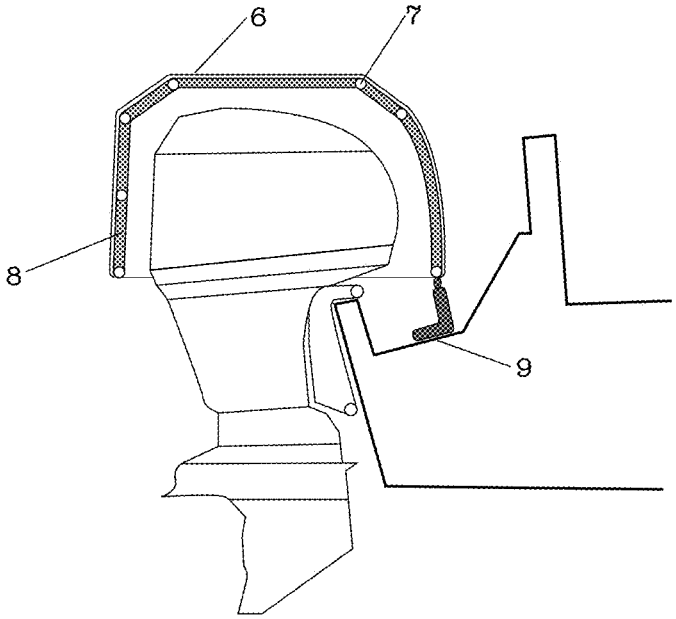
FIG. 7 is a side view of another example of an outboard boat motor cover.

Referring now to FIG. 7 a detail view of cover 2 is provided. Cover 2 may be implemented to obtain specific functions according to the frame material and structure 7, the interior material 8, the exterior barrier material 6 and the attachment 9.

Further still, the construction details shown in FIG. 7 are that cover 2 can be made of rigid composite or of any other sufficiently rigid and strong material such as high-strength plastic, metal, and the like. Cover 2 can be made of flexible material over a frame material. Cover 2 interior material can be part of the frame. Cover 2 interior can be separate from the frame and flexible. Cover 2 can be moveable and collapsible. Cover 2 can have an attachment 9 to boat 1 and/or motor 4.

Figure 8:
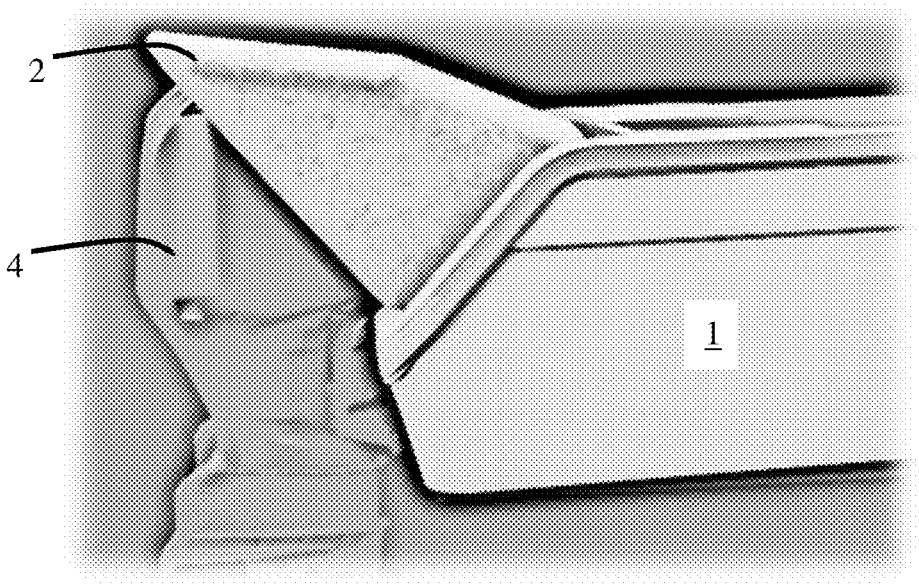
FIG. 8 is a side view of another example of an outboard boat motor cover.

FIG. 8 shows an example implementation of cover 2. In the example in FIG. 8, cover 2 does not cover an entirety of a top of motor 4. In the mode shown in FIG. 8, cover 2 may redirect sonic emissions from motor 4 away from boat 1, for example to the aft of boat 1. Cover 2 may be rigidly affixed to boat 1, and/or maybe hinged to permit cover 2 to pivot, generally toward the bow of boat 1. As discussed above, cover 2 may be releasably fastened to boat 1 and/or motor 4. Alternatively, or in addition, cover 2 may be integral with boat 1 and/or motor 4.

Figure 9:
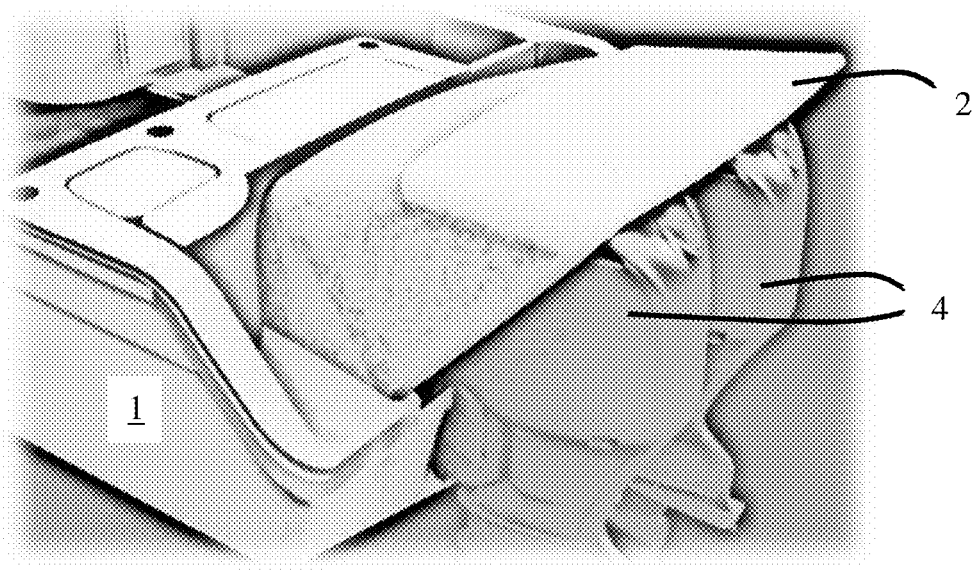
FIG. 9 is a perspective view of another example of an outboard boat motor cover for more than one motor.
Figure 10:
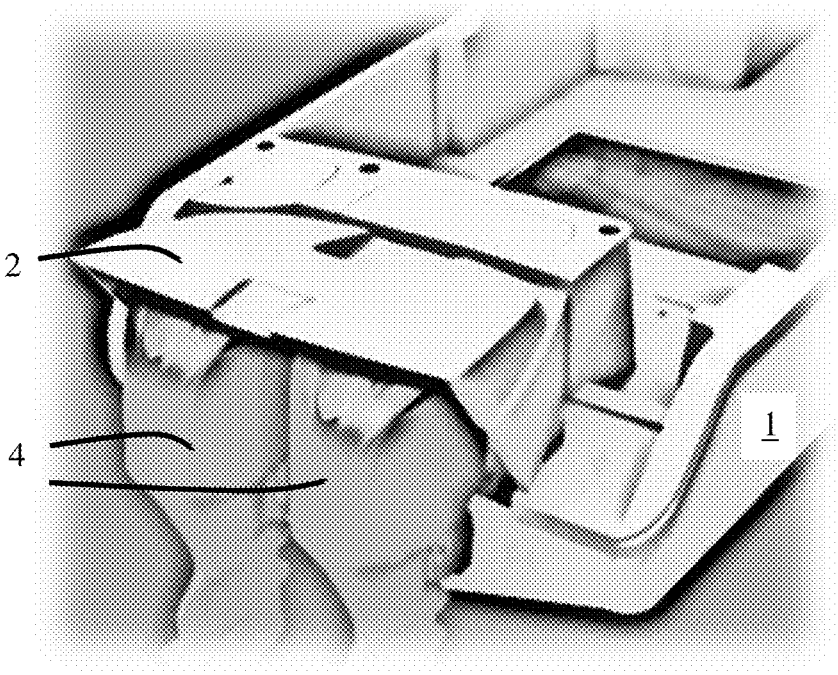
FIG. 10 is a perspective view of another example of an outboard boat motor cover for more than one motor.

FIGS. 9 and 10 illustrate cover 2 in use with multiple motors 4. In this example, cover 2 can be implemented as described in any of the above examples. Moreover, cover 2 can be implemented to be used with any number of outboard boat motors 4.

Figure 11:
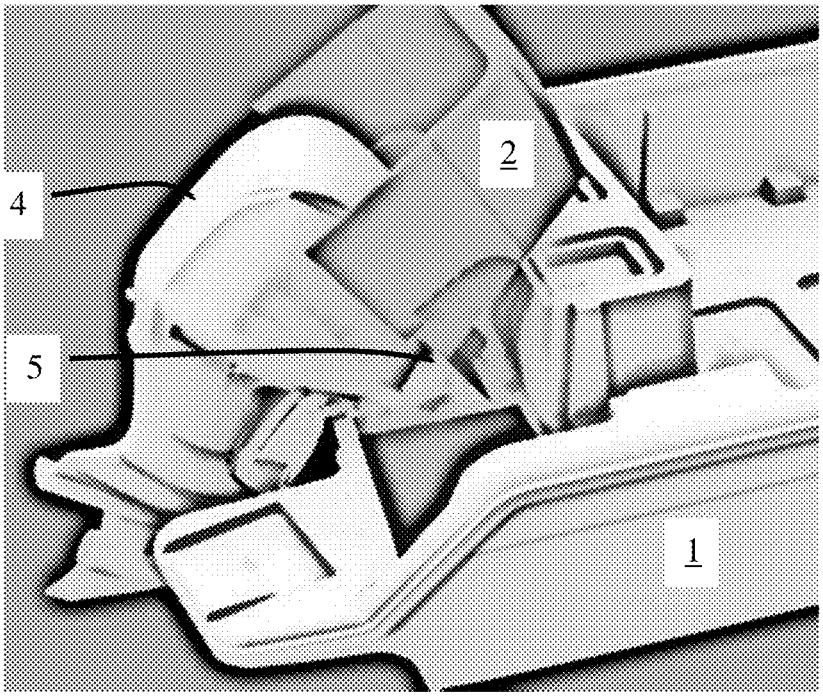
FIG. 11 is a perspective view of another example of an outboard boat motor cover in a tilted position.

FIG. 11 illustrates cover 2 in a pivoted position about hinge 5. Motor 4 is shown in a pivoted position as well. Cover 2 may also be removable to permit greater access to motor 4. Although cover 2 is shown pivoting towards a bow of boat 1, any pivoting arrangement is possible. For example, cover 2 may be hinged on a starboard, port or aft side. Cover 2 may also or alternatively be fastened, releasably or otherwise, to boat 1 and/or motor 4 on any or several sides.

Figure 12:
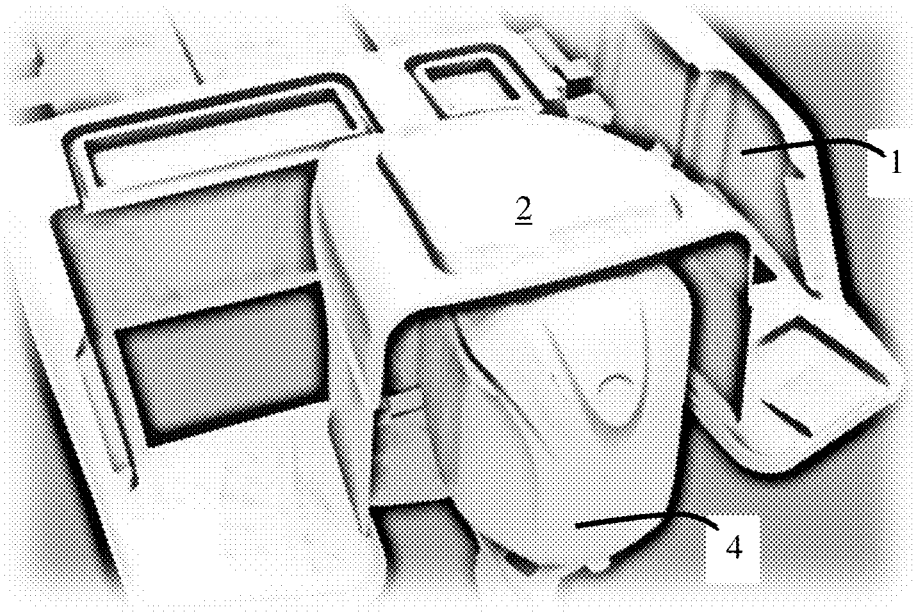
FIG. 12 is a perspective view of another example of an outboard boat motor cover.

FIG. 12 illustrates cover 2 adjacent to three sides of motor 4. Cover 2 is spaced from sides of motor 4, which may provide clearance for motor 4 to swivel as boat 1 is steered in different directions. Cover 2 may be integral with boat 1, which may provide better exclusion of sonic emissions from motor 4.

In some or any of the examples discussed herein, cover 2 can be composed of multiple layers of material or a single material. The material can be implemented as an acoustic reflector, such that sonic emissions from motor 4 are directed away from boat 1. Alternatively, or in addition, cover 2 can be composed of material that absorbs or attenuates sonic emissions from motor 4. When cover 2 is implemented with multiple layers, rigid and/or flexible materials may be provided in separate layers. For example, a number of rigid layers may be sandwiched and/or molded together to form cover 2. One or more of the rigid layers may be plastic, and one or more of the rigid layers may be metal. The same may be true of cover 2 implemented as a flexible material, where one or more layers may be a plastic mesh, and one or more layers may be a metal mesh. Flexible layers may include canvas or any other type of textile or fabric. In some examples, a flexible layer may be composed of vinyl, fiberglass, or Stamoid (marine grade waterproof vinyl fabric). Any type of combination of flexible and/or rigid material in layers may be used to construct cover 2. Cover 2 may be composed of sound absorbing or attenuating material, such as foam rubber or any other types of materials that can serve this purpose. The materials may be configured with particular shapes that contribute to attenuating or reflecting sonic emissions from motor 4. For example, cover 2 may include a layer of material that is shaped with alternating peaks and valleys, sometimes referred to as "egg crate" shape. Sound from motor 4 applied to such a shaped material may be attenuated in the valleys of the egg crate shape. Other types of shape configurations may be used, including providing a series of ribs.

The advantages of the present disclosure include, without limitation, a reduction in noise generated from motor 4, a shelter of motor 4 from the elements and a portable cover 2 for motor 4. Further, cover 2 provides a safer environment for boat operators and passengers. In some examples, cover 2 can be implemented to obtain vibrational damping for motor 4.

According to an example implementation, a cover 2, such as that illustrated in FIG. 8, was constructed of 0.125" thick vinyl with a 0.50" fiberglass layer inside a double Stamoid waterproof cover. The construction of the example was flexible, with a stainless steel pipe frame being provided for support. The pipe frame was constructed to be mounted over the motor and secured to the motor well, as illustrated in FIG. 8. The example cover was collapsible, foldable and portable, as well as being releasably fastened to the motor well. The example cover was tested on a rib boat with a 40 hp Yamaha 3 cylinder, 2 cycle outboard motor. The resulting sound levels were measured and tabulated for various speeds at different locations in the boat, with and without the example cover. The results are tabulated in Table 1 (no cover) and in Table 2 (with cover) below.

TABLE 1

| No Cover | | |
|---|---|---|
| Speed | Meter Position | dbA |
| Idle in gear 3-4 kts. | Helm | 69 |
| " | Passenger | 62.5 |
| Cruise 15 kts. | Helm | 85 |
| " | Passenger | 85 |
| Full speed 21.5 kts. | Helm | 99 |
| " | Passenger | 95 |

TABLE 2

| With Cover | | | |
|---|---|---|---|
| Speed | Position | dbA | Delta |
| Idle in gear 3-4 kts | Helm | 62 | −7 |
| " | Passenger | 57 | −5.5 |
| Cruise −15 knots | Helm | | |
| " | Passenger | 82 | −3.0 |
| Full speed 21.5 kts. | Helm | 91 | −8 |
| " | Passenger | 86 | −9 |

As can be observed from the data, operation of the motor with the cover in place resulted in a sound magnitude reduction of between 3 and 9 decibels. In acoustic output, the reduction is equivalent to a 25%-50%. The crew observed a noticeable reduction in sound output within the boat.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known processes, structures, and techniques have been shown without unnecessary detail to avoid obscuring the configurations. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

Also, configurations may be described as a process that is depicted as a flow diagram or block diagram. Although each may describe the operations as a sequential process, many of the operations can be performed in parallel or concurrently. In addition, the order of the operations may be rearranged. A process may have additional stages or functions not included in the figure.

Having described several example configurations, various modifications, alternative constructions, and equivalents may be used without departing from the spirit of the disclosure. For example, the above elements may be components of a larger system, wherein other structures or processes may take precedence over or otherwise modify the application of the invention. Also, a number of operations may be undertaken before, during, or after the above elements are considered. Accordingly, the above description does not bound the scope of the claims.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

What is claimed is:

1. A noise reduction device for a boat motor on a boat, comprising:

a cover with a surface configured to be adjacent to at least a front portion of the boat motor;

the cover being attached to one or more of the boat motor or boat; and a material of the cover being configured to one or more of reflect or attenuate soundwaves; and wherein the material is collapsible or foldable.

2. The device of claim 1, wherein the cover comprises a plurality of surfaces, with at least one surface being adjacent to a top of the boat motor and at least another surface being adjacent to a side of the boat motor.

3. The device of claim 1, wherein the cover comprises one or more layers.

4. The device of claim 3, wherein the cover comprises a rigid layer.

5. The device of claim 3, wherein the cover comprises a flexible layer.

6. The device of claim 3, wherein the cover comprises a waterproof layer.

7. The device of claim 1, further comprising a releasable attachment to attach the cover to the boat motor or the boat.

8. The device of claim 1, wherein the cover further comprises a hinge to permit the cover to pivot toward and away from the boat motor.

9. The device of claim 1, further comprising a frame for supporting the cover adjacent to the boat motor.

10. A method for reducing noise emissions from a boat motor on a boat, comprising:

configuring a cover with a surface that includes a material that is configured to one or more of reflect or attenuate soundwaves;

attaching the cover with the surface to one or more of the boat motor or boat, such that the surface is between at least a portion of the boat motor and a passenger area of the boat; and wherein the material is collapsible or foldable.

11. The method of claim 10, further comprising configuring the cover with a plurality of surfaces, with at least one surface being adjacent to a top of the boat motor and at least another surface being adjacent to a side of the boat motor.

12. The method of claim 10, further comprising configuring the cover with one or more of a rigid layer or a flexible layer.

13. The method of claim 10, further comprising configuring the cover with a waterproof layer.

14. The method of claim 10, further comprising attaching the cover to the boat motor or the boat with a releasable attachment.

15. The method of claim 10, further comprising configuring the cover with a hinge to permit the cover to pivot toward and away from the boat motor.

16. The method of claim 10, further comprising providing a frame for supporting the cover adjacent to the boat motor.

17. A sound reduction device for a boat motor on a boat, comprising:

a frame that is adjacent to a portion of the boat motor and that is fastened to the boat motor or the boat;

a flexible cover overlaying the frame;

the cover being configured to one or more of reflect or attenuate soundwaves; and the frame being composed of tubular stainless steel and configured to be collapsible or foldable; and the cover being composed at least in part of vinyl.

18. The device of claim 17, wherein the cover further comprises a plurality of surfaces, with at least one surface being adjacent to a top of the boat motor and at least another surface being adjacent to a side of the boat motor.

19. The device of claim 17, wherein the cover further comprises one or more layers that are one or more of a rigid layer, a flexible layer or a waterproof layer.

20. The device of claim 17, further comprising a releasable attachment to attach the cover to the boat motor or the boat.

* * * * *